US006343419B1

(12) United States Patent
Litman et al.

(10) Patent No.: US 6,343,419 B1
(45) Date of Patent: Feb. 5, 2002

(54) METHOD OF MANUFACTURING MAGNET ASSEMBLY WITH INSERTS

(75) Inventors: Alan M. Litman; Jorge A. Alvarez, both of Webster, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/549,627

(22) Filed: Apr. 14, 2000

Related U.S. Application Data

(62) Division of application No. 08/718,758, filed on Sep. 23, 1996, now Pat. No. 6,125,255.

(51) Int. Cl.[7] ..... B21D 53/00

(52) U.S. Cl. ..... 29/895.32; 29/895.21; 492/8

(58) Field of Search ..... 492/8, 38, 45, 492/53; 29/895.32, 895, 895.21, 895.2, 428, 527.1; 303/305, 306; 355/14 D; 118/657, 658

(56) References Cited

U.S. PATENT DOCUMENTS

| | | | | |
|---|---|---|---|---|
| 4,517,719 | A | 5/1985 | Okumura et al. | 29/124 |
| 4,557,582 | A | 12/1985 | Kan et al. | 355/3 DD |
| 4,604,042 | A | 8/1986 | Tanigawa et al. | 425/3 |
| 4,608,737 | A | 9/1986 | Parks et al. | 29/110 |
| 4,638,281 | A | 1/1987 | Baermann | 335/303 |
| 4,640,805 | A | 2/1987 | Neefe | 264/1.1 |
| 4,645,327 | A | 2/1987 | Kimura et al. | 355/3 R |
| 4,804,971 | A | 2/1989 | Bruns et al. | 343/840 |
| 4,818,305 | A | 4/1989 | Steingroever | 148/103 |
| 4,823,102 | A | 4/1989 | Cherian et al. | 335/306 |
| 4,872,418 | A | 10/1989 | Yoshikawa et al. | 118/657 |
| 5,019,796 | A | 5/1991 | Lee et al. | 335/302 |
| 5,030,937 | A | 7/1991 | Loubier et al. | 335/303 |
| 5,384,957 | A | 1/1995 | Mohri et al. | 29/895.32 |
| 5,453,224 | A | 9/1995 | Kuroda | 264/427 |
| 5,659,861 | A | 8/1997 | Yamashita et al. | 399/267 |
| 5,758,242 | A | 5/1998 | Malespin et al. | 399/277 |
| 5,795,532 | A | 8/1998 | Wagner et al. | 264/429 |

*Primary Examiner*—I. Cuda Rosenbaun

(57) ABSTRACT

A method for manufacturing a magnetic roll for use in an electrophotographic printing machine of the type having an electrostatic latent image recorded on a photoconductive member is provided. The method includes the steps of placing a shaft in a mold cavity and molding a core in the mold cavity with the shaft in the cavity. The core defines a pocket on the periphery of the core. The method further includes the step of attaching a magnet to the pocket.

4 Claims, 9 Drawing Sheets

METHOD OF MANUFACTURING MAGNET ASSEMBLY WITH INSERTS

This application is a divisional of Application Ser. No. 08/718,758, filed Sep. 23, 1996, now U.S. Pat. No. 6,125, 255.

The present invention relates to a method and apparatus for developing a latent image. More specifically, the invention relates to a magnetic roll for development systems.

The features of the present invention are useful in the printing arts and more particularly in electrophotographic printing. In the well-known process of electrophotographic printing, a charge retentive surface, typically known as a photoreceptor, is electrostatically charged, and then exposed to a light pattern of an original image to selectively discharge the surface in accordance therewith. The resulting pattern of charged and discharged areas on the photoreceptor form an electrostatic charge pattern, known as a latent image, conforming to the original image. The latent image is developed by contacting it with a finely divided electrostatically attractable powder known as "toner." Toner is held on the image areas by the electrostatic charge on the photoreceptor surface. Thus, a toner image is produced in conformity with a light image of the original being reproduced. The toner image may then be transferred to a substrate or support member (e.g., paper), and the image affixed thereto to form a permanent record of the image to be reproduced. Subsequent to development, excess toner left on the charge retentive surface is cleaned from the surface. The process is useful for light lens copying from an original or printing electronically generated or stored originals such as with a raster output scanner (ROS), where a charged surface may be imagewise discharged in a variety of ways.

In the process of electrophotographic printing, the step of conveying toner to the latent image on the photoreceptor is known as "development." The object of effective development of a latent image on the photoreceptor is to convey toner particles to the latent image at a controlled rate so that the toner particles effectively adhere electrostatically to the charged areas on the latent image. A commonly used technique for development is the use of a two-component developer material, which comprises, in addition to the toner particles which are intended to adhere to the photoreceptor, a quantity of magnetic carrier granules or beads. The toner particles adhere triboelectrically to the relatively large carrier beads, which are typically made of steel. When the developer material is placed in a magnetic field, the carrier beads with the toner particles thereon form what is known as a magnetic brush, wherein the carrier beads form relatively long chains which resemble the fibers of a brush. This magnetic brush is typically created by means of a "developer roll." The developer roll is typically in the form of a cylindrical sleeve rotating around a fixed assembly of permanent magnets called a magnetic roll. The carrier beads form chains extending from the surface of the developer roll, and the toner particles are electrostatically attracted to the chains of carrier beads. When the magnetic brush is introduced into a development zone adjacent the electrostatic latent image on a photoreceptor, the electrostatic charge on the photoreceptor will cause the toner particles to be pulled off the carrier beads and onto the photoreceptor. Another known development technique involves a single-component developer, that is, a developer which consists entirely of toner. In a common type of single-component system, each toner particle has both an electrostatic charge (to enable the particles to adhere to the photoreceptor) and magnetic properties (to allow the particles to be magnetically conveyed to the photoreceptor). Instead of using magnetic carrier beads to form a magnetic brush, the magnetized toner particles are caused to adhere directly to a developer roll. In the development zone adjacent the electrostatic latent image on a photoreceptor, the electrostatic charge on the photoreceptor will cause the toner particles to be attracted from the developer roll to the photoreceptor.

As stated earlier, development is typically accomplished by the use of a magnetic brush. The magnetic brush is typically formed by a developer roll which is typically in the form of a cylindrical sleeve which rotates around a fixed assembly of permanent magnets. When utilizing magnetic brush-type development, the cylindrical sleeve is typically made of an electrically conductive, non-magnetically conductive material, for example, aluminum.

Prior art developer rolls for use with magnetic pressure development typically include a magnetic roll about which a sleeve is positioned. The magnetic roll may be held stationary and the sleeve rotates. Conversely, the sleeve may rotate with the magnetic roll permanently positioned. In configurations where the magnetic roll is stationary and the sleeve rotates, the segments are so positioned to attract the toner particles toward the developer nip between the developer roll and the photoconductive surface of the drum.

Prior art developer rolls have typically been manufactured with a core or body and magnets positioned on the periphery of the core. Typically the magnets are glued to the periphery of the core. The gluing of magnets to a core contributes to a series of problems. The gluing leads to positioning errors both radially and tangentially, reducing the quality of the roll. Further, add cost may be required to perform subsequent machining of the periphery of the roll to obtain needed accurate tolerances. Furthermore, the adhesive use to glue the magnets to the core may require special handling to conform to environmental and safety regulations. In addition, the gluing of the magnets to the core is a labor intensive hand operation which is very costly. Also, the use of glued magnet segments leads to a magnetic roll that is hard to disassemble for remanufacturing. While it may be difficult to remove the glue to separate the magnets from the core, it is further more difficult to remove the residual glue from the core and the magnets. It is further difficult to dispose of the residual glue and remove from the magnets and core.

Recently, magnetic rolls had been manufactured by positioning the magnetic strips around the periphery of a mold and molding the core with the magnetic strips prepositioned in the core of the mold. This manufacturing procedure utilizes an expensive molding. Further, the process is limited to urethane resins. The process is expensive in that the curing time for the molding operation may be extensive. Also the elevated temperatures required result in long cure times. The requirement that the process utilize urethane foam limits the flexibility of the process and the limited strength and durability of the urethane foam affect the quality and suitability of this type of magnetic roll in many applications.

The magnetic roll of the present invention is intended to alleviate at least some of the aforementioned problems.

The following disclosures may be relevant to various aspects of the present invention:

U.S. Pat. No. 5,453,224

Patentee: Kuroda

Issue Date: Sep. 26, 1995

U.S. Pat. No. 5,384,957

Patentee: Mohri et al.

Issue Date: Jan. 31, 1995

U.S. Pat. No. 5,030,937

Patentee: Loubier et al.

Issue Date: Jul. 9, 1991

U.S. Pat. No. 5,019,796

Patentee: Lee et al.

Issue Date: May 28, 1991

U.S. Pat. No. 4,872,418

Patentee: Yoshikawa et al.

Issue Date: Oct. 10,1989

U.S. Pat. No. 4,823,102

Patentee: Cherian et al.

Issue Date: Apr. 18, 1989

U.S. Pat. No. 4,608,737

Patentee: Parks et al.

Issue Date: Sep. 2, 1986

U.S. Pat. No. 4,604,042

Patentee: Tanigawa et al.

Issue Date: Aug. 5, 1986

U.S. Pat. No. 4,557,582

Patentee: Kan et al.

Issue Date: Dec. 10,1985

U.S. Pat. No. 4,517,719

Patentee: Okumura et al.

Issue Date: May 21, 1985

U.S. Pat. No. 5,453,471 discloses a hollow member which serves as a cylinder having an inner configuration which matches the outer configuration of a magnet roller to be manufactured. The member is mounted in a metallic mold and then the metallic mold is clamped. A molten resin containing magnetic particles is injected into the mold cavity of the hollow member through a runner.

U.S. Pat. No. 5,384,957 discloses a method of producing a magnet roll in which a magnetic property comparable to that obtained by injection molding can be obtained in spite of an extrusion process. According to a first embodiment, the yoke width of the magnetic field extrusion die is varied along an extrusion direction. According to a second embodiment, a pipe filled with resin bonded magnet material is used as a shaft.

U.S. Pat. No. 5,030,937 discloses a magnet roll for an electro-photographic device. The roll includes a magnet carrier assembly constituted by a plurality of identical cylindrical segments of injection molded plastic material. The segments are coaxially arranged and longitudinally aligned in an end-to-end relationship on a spindle like metal rod constituting the magnet roll axis of rotation. The bottom of each channel has along its length a central groove that functions as a locator for an extruded magnetic strip.

U.S. Pat. No. 5,019,796 discloses an improved bar magnet and method of construction and an improved magnetic core. An assembly of magnet is shown for use in a processing station of a printing machine. The bar magnet is formed of permanent magnet material having magnetic domains therein that are magnetized along epicyclical curve segments. The external magnetic flux density is improved over that of a conventionally magnetized magnet.

U.S. Pat. No. 4,872,418 discloses a magnet roll including a main body portion of a soft material and having a surface portion which is permanently magnetized. The roll also has a supporting portion integrally formed with the main body portion by the some soft materials a that of the main body portion for mounting the body portion to a member to which the main body is to be mounted.

U.S. Pat. No. 4,823,102 discloses a magnetic roll which is used in a processing station of a printing machine. The roll has a central portion with a plurality of spaced fins extending generally radially therefrom. A shaft extends outwardly from opposed ends of the central portion along the longitudinal axis thereof. A magnet is secured in each space between adjacent fins. A sleeve is rotatably supported on the shaft.

U.S. Pat. No. 4,804,971 discloses a cylindrical magnet for a magnetic brush development unit used in a printing machine. The magnet is of a U-shaped cross section having a cylindrical outer sleeve and a cavity through which extends the rotary axis of the sleeve. The material forming the magnet is a moldable plastic.

U.S. Pat. No. 4,608,737 discloses a magnet roll for use in a developer unit of an electrostatic copier having a magnet structure provided by elongated bars of permanent magnet material magnetized to provide radially oriented magnets. The bars are sufficiently rigid to support hubs without the need of a core. A cylindrical shell of conductive material is rotatably mounted on the magnet structure. The bars are made of conductive plastic, ceramic or rubber with a rigid steel backing.

U.S. Pat. No. 4,604,042 discloses a mold for producing an anisotropic magnet from a composition consisting essentially of magnetic powder and a binder. The mold includes a mold body, a cavity for molding the composition, yokes and first and second magnets on both sides of the yokes for preventing leakage of the magnetic field.

U.S. Pat. No. 4,557,582 discloses a magnet roll including magnet pieces adhesively secured to a supporting shaft to increase the magnetic flux density of a pole. The pieces are disposed do that they have repelling magnetic forces in the interface between the piece have the pole and the piece adjacent thereto.

U.S. Pat. No. 4,517,719 discloses a magnetic roll having a plurality of magnets integrally set fast with a retaining member to form a magnetic force generating part. The retaining member is made of a rigid synthetic resin or resin foam and a groove is provided outside of the magnetic force generating part.

In accordance with one aspect of the present invention, there is provided a method for manufacturing a magnetic roll for use in an electrophotographic printing machine of the type having an electrostatic latent image recorded on a photoconductive member. The method includes the steps of placing a shaft in a mold cavity and molding a core in the mold cavity with the shaft in the cavity. The core defines a pocket on the periphery of the core. The method further includes the step of attaching a magnet to the pocket.

In accordance with another aspect of the present invention, there is provided a magnetic roll for use in an electrophotographic printing machine of the type having an electrostatic latent image recorded on a photoconductive member in which a magnetic field attracts magnetic particles to form a magnetic brush on a sleeve surrounding a portion of the roll. The magnetic roll includes an elongated member and a core made of a moldable material. The core is molded onto the member. The core defines a pocket located on the periphery of the core. The magnetic roll further includes a magnet secured to the pocket.

In accordance with yet another aspect of the present invention, there is provided a developer unit for use in an electrophotographic printing machine of the type having an electrostatic latent image recorded on a photoconductive member. The developer unit includes a housing defining a chamber for storing a supply of toner particles therein and a magnetic roll for transporting the toner particles on a sleeve surrounding a portion of the roll from the chamber of the housing to the member. The magnetic roll includes an elongated member and a core made of a moldable material. The core is molded onto the elongated member. The core defines a pocket located on the periphery of the core. The magnetic roll further includes a magnet secured to the pocket.

In accordance with a further aspect of the present invention, there is provided an electrographic printing machine of the type having an electrostatic latent image recorded on a photoconductive member. The printing machine includes a housing defining a chamber for storing a supply of toner particles therein and a magnetic roll for transporting the toner particles on a sleeve surrounding a portion of the roll from the chamber of the housing to the member. The magnetic roll includes an elongated member and a core made of a moldable material. The core is molded onto the elongated member The core defines a pocket located on the periphery of the core. The magnetic roll further includes a magnet secured to the pocket.

BRIEF DESCRIPTION OF THE DRAWINGS

The invention will be described in detail herein with reference to the following figures in which like reference numerals denote like elements and wherein.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 3:
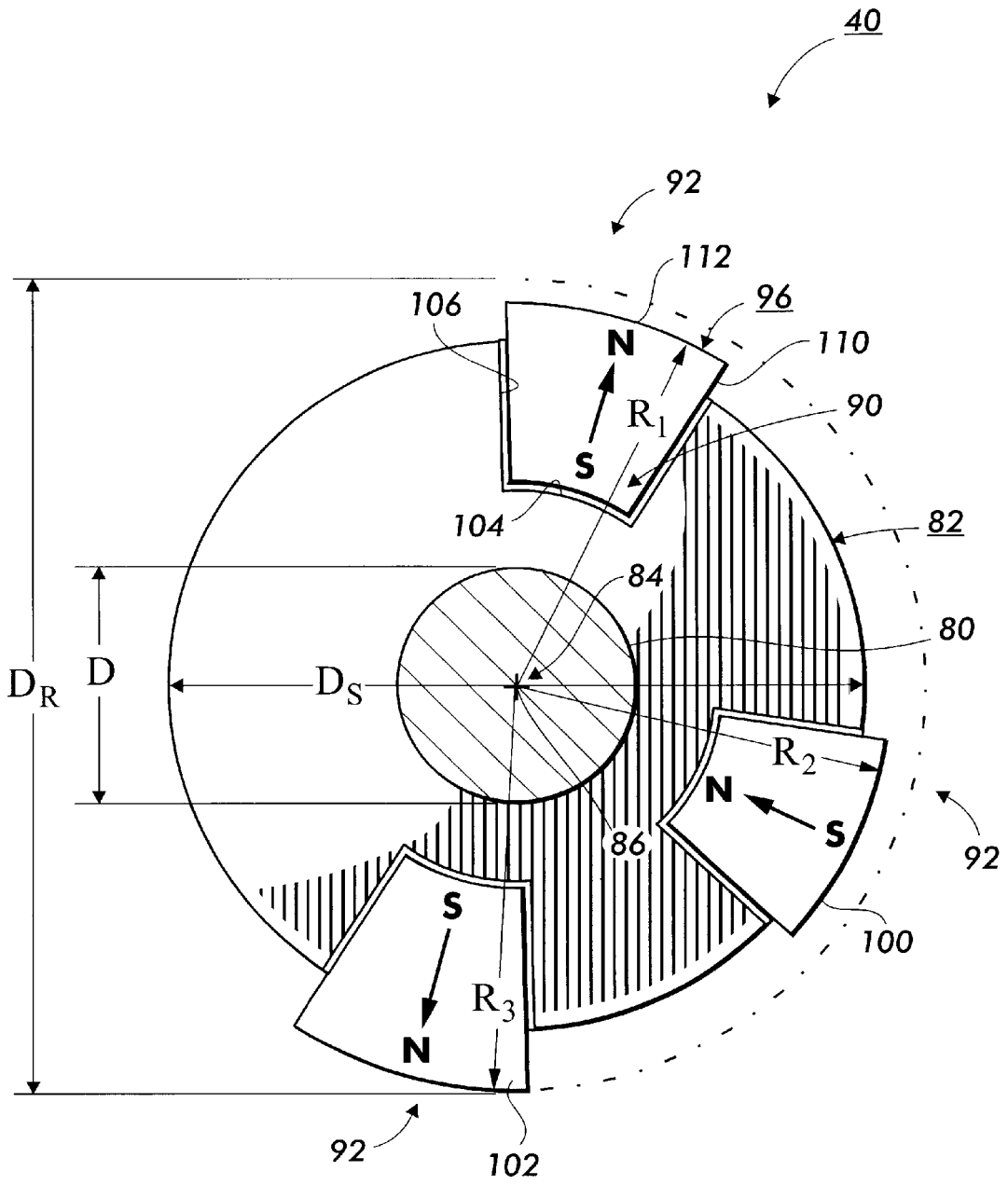
FIG. 3 is a sectional view along the line 3—3 in the direction of the arrows of the molded pocket magnetic roll of FIG. 1.

For a general understanding of the illustrative electrophotographic printing machine incorporating the features of the present invention therein, reference is made to the drawings. In the drawings, like reference numerals have been used throughout to designate identical elements. FIG. 3 schematically depicts the various components of an electrophotographic printing machine incorporating the developing device of the present invention therein. Although the developing device of the present invention is particularly well adapted for use in the illustrative printing machine, it will become evident that the developing device is equally well suited for use in a wide variety of printing machines and are not necessarily limited in its application to the particular embodiment shown herein.

Figure 2:
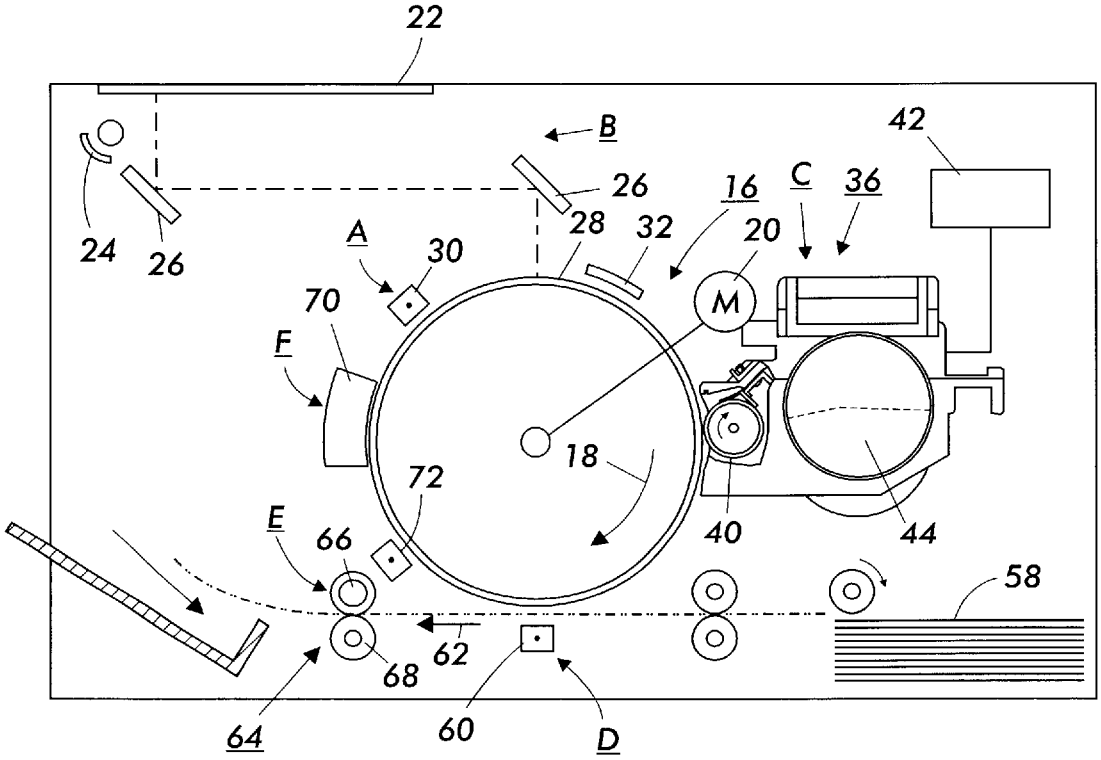
FIG. 2 is a schematic elevational view of an illustrative electrophotographic printing machine incorporating the molded pocket magnetic roll of the present invention therein.

Referring now to FIG. 2, the electrophotographic printing machine shown employs a photoconductive drum 16, although photoreceptors in the form of a belt are also known, and may be substituted therefor. The drum 16 has a photoconductive surface deposited on a conductive substrate. Drum 16 moves in the direction of arrow 18 to advance successive portions thereof sequentially through the various processing stations disposed about the path of movement thereof. Motor 20 rotates drum 16 to advance drum 16 in the direction of arrow 18. Drum 16 is coupled to motor 20 by suitable means such as a drive.

Initially successive portions of drum 16 pass through charging station A. At charging station A, a corona generating device, indicated generally by the reference numeral 30, charges the drum 16 to a selectively high uniform electrical potential, preferably negative. Any suitable control, well known in the art, may be employed for controlling the corona generating device 30.

A document to be reproduced is placed on a platen 22, located at imaging station B, where it is illuminated in known manner by a light source such as a tungsten halogen lamp 24. The document thus exposed is imaged onto the drum 16 by a system of mirrors 26, as shown. The optical image selectively discharges surface 28 of the drum 16 in an image configuration whereby an electrostatic latent image 32 of the original document is recorded on the drum 16 at the imaging station B.

At development station C, a magnetic development system or unit, indicated generally by the reference numeral 36 advances developer materials into contact with the electrostatic latent images. Preferably, the magnetic developer unit includes a magnetic developer roll mounted in a housing. Thus, developer unit 36 contains a developer roll 116. The roll 116 advances toner particles into contact with the latent image. Appropriate developer biasing is may be accomplished via power supply 42, electrically connected to developer unit 36.

The developer unit 36 develops the charged image areas of the photoconductive surface. This developer unit contains magnetic black toner, for example, particles 44 which are charged by the electrostatic field existing between the photoconductive surface and the electrically biased developer roll in the developer unit. Power supply 42 electrically biases the developer roll 116.

A sheet of support material 58 is moved into contact with the toner image at transfer station D. The sheet of support material is advanced to transfer station D by a suitable sheet feeding apparatus, not shown. Preferably, the sheet feeding apparatus includes a feed roll contacting the uppermost sheet of a stack copy sheets. Feed rolls rotate so as to advance the uppermost sheet from the stack into a chute which directs the advancing sheet of support material into contact with the photoconductive surface of drum 16 in a timed sequence so that the toner powder image developed thereon contacts the advancing sheet of support material at transfer station D.

Transfer station D includes a corona generating device 60 which sprays ions of a suitable polarity onto the backside of sheet 58. This attracts the toner powder image from the drum 16 to sheet 58. After transfer, the sheet continues to move, in the direction of arrow 62, onto a conveyor (not shown) which advances the sheet to fusing station E.

Fusing station E includes a fuser assembly, indicated generally by the reference numeral 64, which permanently affixes the transferred powder image to sheet 58. Preferably, fuser assembly 64 comprises a heated fuser roller 66 and a pressure roller 68. Sheet 58 passes between fuser roller 66 and pressure roller 68 with the toner powder image contacting fuser roller 66. In this manner, the toner powder image is permanently affixed to sheet 58. After fusing, a chute, not shown, guides the advancing sheet 58 to a catch tray, also not shown, for subsequent removal from the printing machine by the operator. It will also be understood that other post-fusing operations can be included, for example, stapling, binding, inverting and returning the sheet for duplexing and the like.

After the sheet of support material is separated from the photoconductive surface of drum 16, the residual toner particles carried by image and the non-image areas on the photoconductive surface are charged to a suitable polarity and level by a preclean charging device 72 to enable removal therefrom. These particles are removed at cleaning station F. The vacuum assisted, electrostatic, brush cleaner unit 70 is disposed at the cleaner station F. The cleaner unit has two brush rolls that rotate at relatively high speeds which creates mechanical forces that tend to sweep the residual toner particles into an air stream (provided by a vacuum source), and then into a waste container. Subsequent to cleaning, a discharge lamp or corona generating device (not shown) dissipates any residual electrostatic charge remaining prior to the charging thereof for the next successive imaging cycle.

It is believed that the foregoing description is sufficient for purposes of the present application to illustrate the general operation of an electrophotographic printing machine incorporating the development apparatus of the present invention therein.

Figure 1:
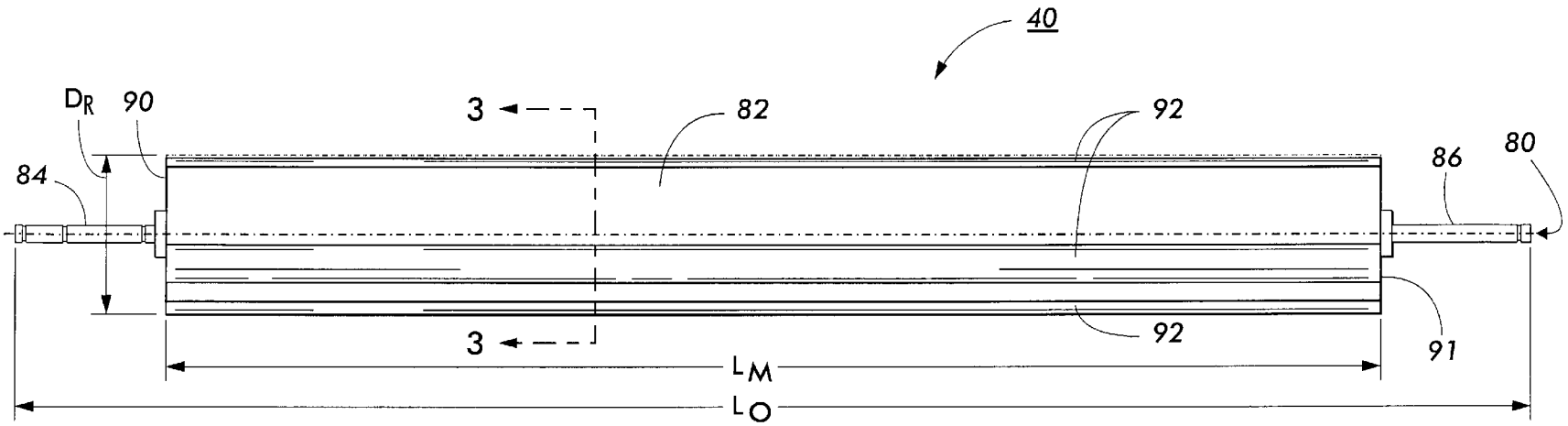
FIG. 1 is an elevational view of a molded pocket magnetic roll according to the present invention.

According to the present invention and referring to FIG. 1, developer roll 116 is shown I the form of an assembly. The developer roll 116 typically is an assembly which includes a magnetic roll 40 and a sleeve or tube 114 which is rotatably fitted about the periphery of the magnetic roll 40. The magnetic roll 40 is typically in the form of an assembly and includes a shaft 80 about which a core 82 is positioned. The shaft 80 serves to position the magnetic roll 40 and as such the shaft 80 has a length of $L_O$ larger than length $L_M$ of the core 82. First and second journals 84 and 86 respectively extend outwardly from first and second ends 90 and 91 respectively of the core 82.

Referring now to FIG. 3, a cross-section of the magnetic roll 40 is shown in greater detail. The shaft 80 is made of any suitable durable material capable of supporting the core 82. For example, the shaft 80 may be made of a metal, for example, steel. An example such as suitable material is cold rolled steel, for example SAE 1020. The shaft may have any shape but typically has a cylindrical shape having a diameter D of sufficient size to be capable of supporting the magnetic roll 40.

Core 82 is positioned about shaft 80. Core 82 is preferably molded onto shaft 80. The core 82 has a diameter $D_S$ of approximately 1.7 inches for a magnetic roll 40 having a diameter $D_R$ of approximately two inches. The core 82 has a sleeve centerline 84 which is coincident with centerline 86 of shaft 80. The core 82 preferably has pockets 90 for properly positioning magnets 92 about periphery 94 of the core 82. While the invention may be practiced with a single magnet 92, preferably the magnetic roll 40 includes a plurality of magnets 92. For example, as shown in FIG. 3, the magnetic roll 40 includes first magnet 96, second magnet 100 and third magnet 102. The relative angular positions and the radii of the periphery of the magnets 96, 100 and 102 are so chosen to obtain the desired magnetic fields to best transfer the marking particles from the developer housing to the photoconductive drum.

The pockets 90 may have any suitable shape but preferably include a bottom 104 and first and second walls 106 and 110 extending radially outward from bottom 104. The pockets are so positioned and sized such that outer periphery 112 of the magnet 96 define radius $R_1$ from centerline 86 of the shaft 80. Similarly the outer peripheries of magnet 100 and magnet 102 define radii $R_2$ and $R_3$, respectively. It should be appreciated to effect different magnetic strengths at each of the magnets 96, 100 and 102, the radii $R_1$, $R_2$ and $R_3$ may be different.

The magnets 92 are made of any suitable durable material that is permanently magnetizable. For example, the magnets 92 may be made of a ferrous metal or be made of a plastic material including magnetizable materials dispersed therein. While the magnets 92 may have any suitable shape, typically the magnets 92 have a uniform cross-section as shown in FIG. 3 which uniform cross-section extends in a direction parallel to centerline 86 of the shaft 80. The magnets 92 may be magnetized with any suitable polarity. For example, as shown in FIG. 3, the periphery 112 of the magnet 96 may be defined as a north pole N while the bottom 113 of the magnet 96 may be defined as a south pole S. Other magnets may have similar or opposite polarity to that of magnet 96. For example, the periphery of the magnet 100 may be defined as a south pole S while the bottom of the magnet 100 may be defined as a north pole N. Further, the periphery of the magnet 102 may be defined as a north pole N while the bottom of the magnet 102 may be defined as a south pole S.

The core 82 may be made of any suitable durable moldable or castable material. For example, the core material may be a polyester, a nylon, an acrylic, a urethane or an epoxy. The core material may be any castable resin that is castable at low pressures. This core material may be fortified with fillers, for example, milled glass, glass fibers, conductive fillers, or reinforcements. Further, the core 82 may include microballoons (not shown). The microballoons having a generally spherical shape and having a diameter of approximately 20 to 130 microns, with approximately 60 microns being preferred. A cellular structure can be created by dispersing a gas within the molding material during the molding process to manufacture the core 82 or a chemical blowing agent may be added which decomposes during the molding process to a gas which provides the cellular structure.

Figure 4:
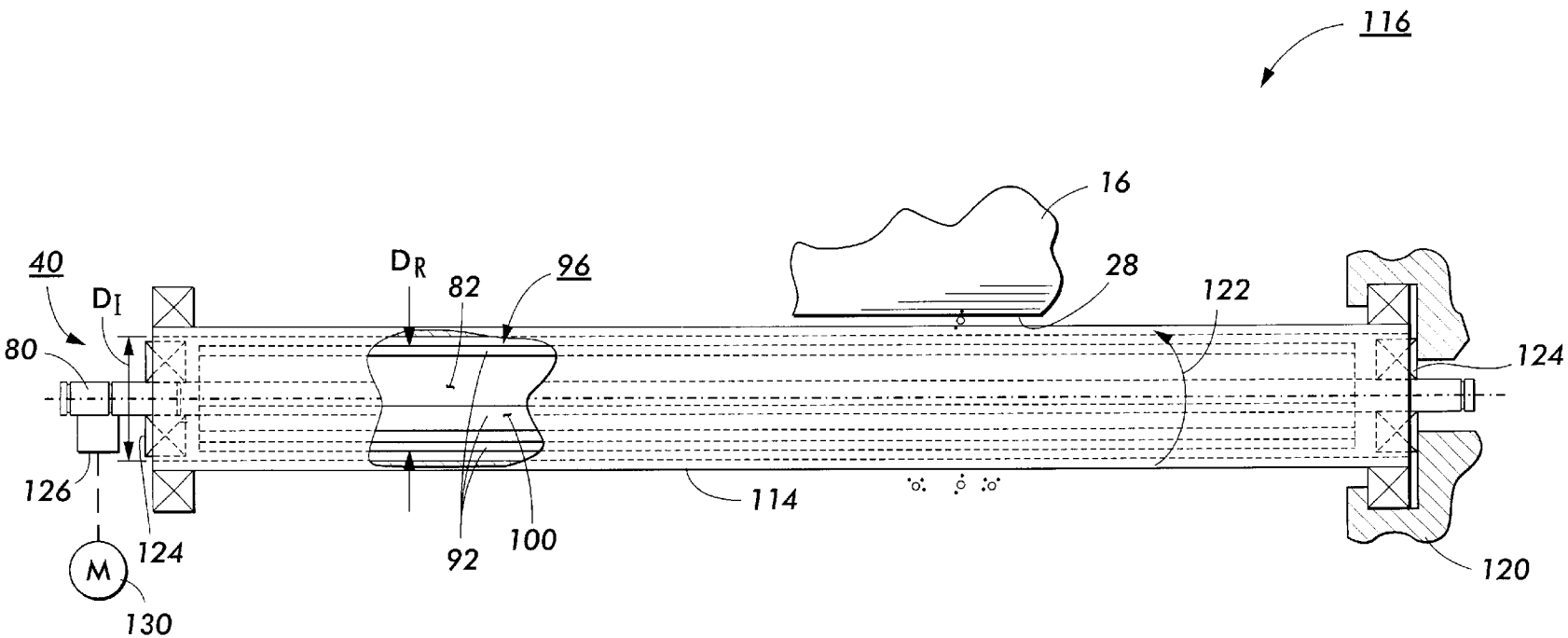
FIG. 4 is an elevational view of the molded pocket magnetic roll of FIG. 1 assembled in a development sleeve to form a developer roll.

Referring now to FIG. 4, the magnetic roll 40 is shown assembled within a sleeve or tube 114 to form the developer roll 116. The tube 114 may be made of any suitable durable non ferromagnetic materials, for example, aluminum or plastic.

The tube 114 has a inner diameter $D_I$ which is slightly larger than diameter DR of the magnetic roller 40. The tube 114 and the magnetic roller 40 serve to form the developer roll 116 which is typically an assembly 116. The developer roll 116 may operate by either a stationary tube 114 having a rotating magnetic roll 40 located therein or by having a rotating tube 114 rotating about a fixed magnetic roll 40. it should also be appreciated that the tube 114 and the roller 40 may ultimately both rotate in either the same or opposed directions.

As shown in FIG. 4, the tube 114 is rotatably secured to developer housing 120 and is driven by a power source (not shown) in an appropriate direction to advance the toner to the photoreceptor. The magnetic roll 40 rotates in the direction of arrow 122 supported at shaft 80 by bearings 124. The bearings are mounted in the inner periphery of tube 114. The magnetic roll 40 is rotated by drive mechanism 126 which is driven by a suitable power source, for example, motor 130. The magnets 92 of the magnetic roll 40 thus advances the developer material around the periphery of the tube 114 in the direction of arrow 122 toward the photoreceptive surface 28 of drum 16.

Figure 5:
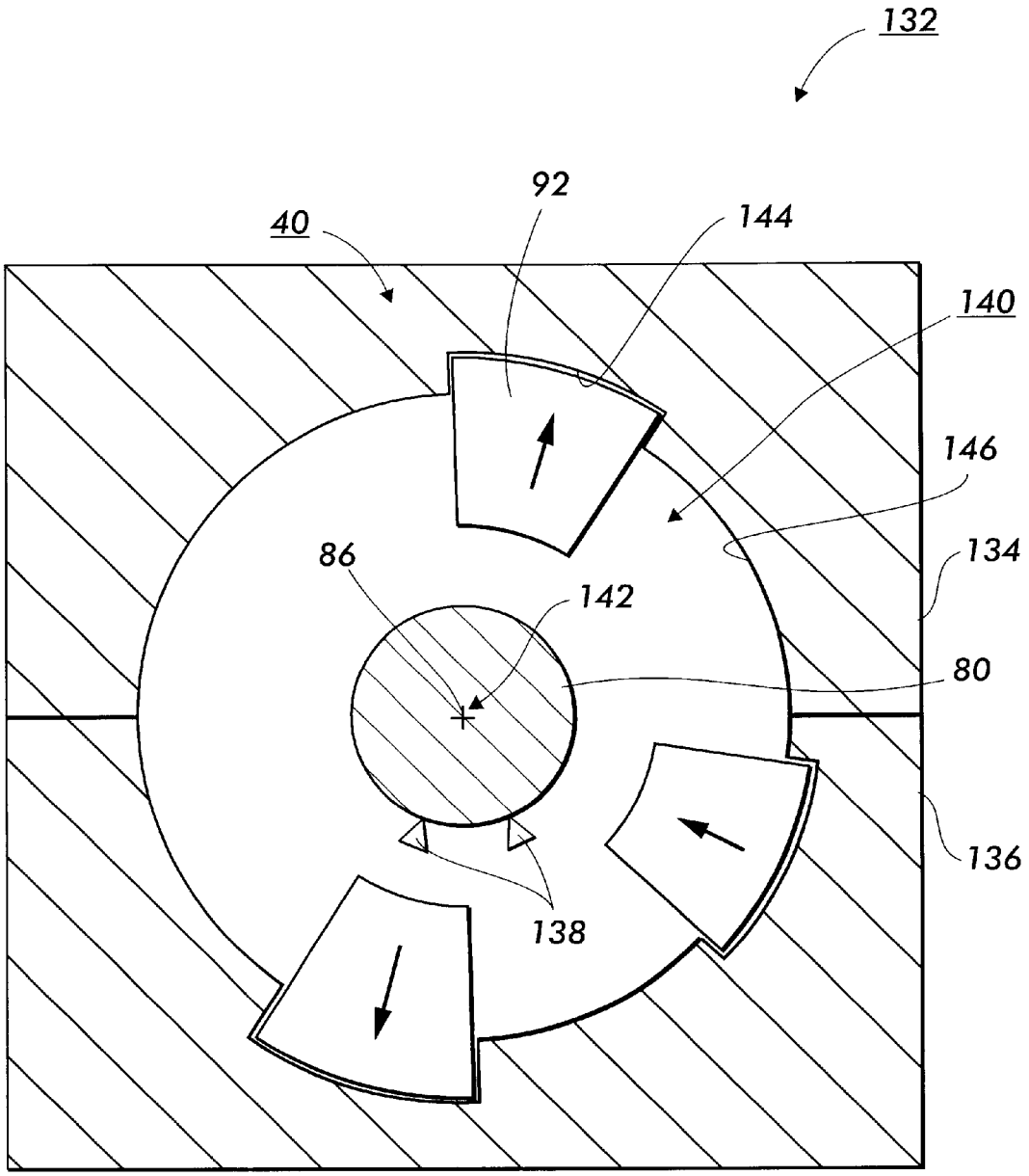
FIG. 5 is an elevational view of a mold for a magnetic roll including a molded pocket for use in the molded pocket magnetic roll of FIG. 1.

Now referring to FIG. 5, a mold 132 is shown for use in manufacturing the magnetic roll 40 of FIG. 1. The mold 132 of FIG. 5 is shown in a cross-sectional view. While the mold 132 may be an integral mold, as shown in FIG. 5, the mold 132 may include a first die half 134 and a second die half 136. It should be appreciated that more than two die segments may be required to remove the magnetic roll 40 from the mold 132. Also, the magnetic roll 40 may be drawn out of an integral mold.

Supports 138 are used to position the shaft 80 within mold cavity 140. To provide for a central location of the shaft 80 within the mold cavity 140, shaft centerline 86 is positioned coincidental with mold cavity centerline 142. The mold cavity 140 preferably includes magnet channels 144 for positioning the magnets 92 within the mold cavity 140. The channels 144 are located on periphery 146 of the mold cavity 140. The mold 132 receives the mold resin and performs the molding operation at low pressure.

Figure 6:
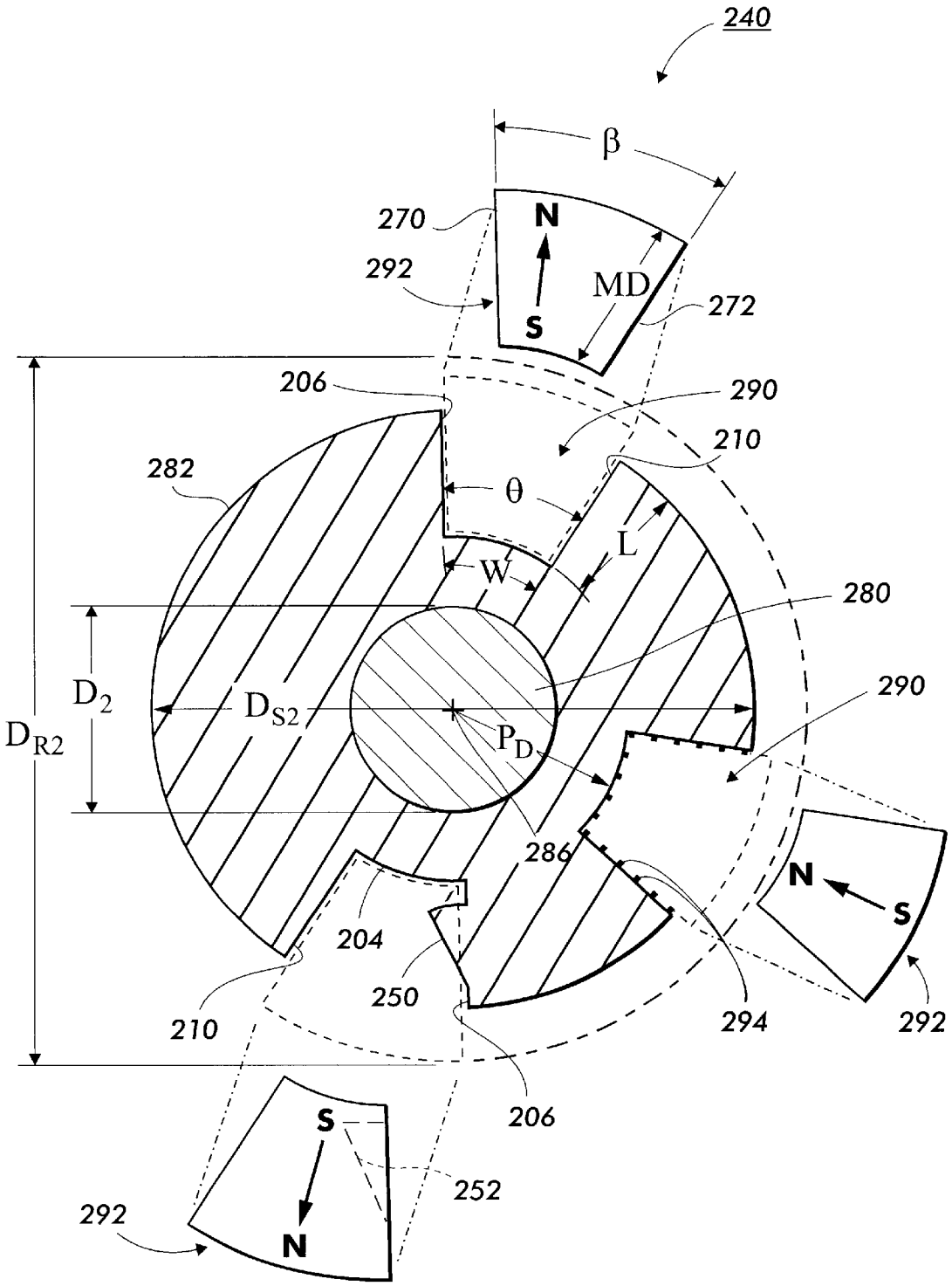
FIG. 6 is a sectional view of an alternate embodiment of a molded pocket magnetic roll with separately molded magnets.

While the invention may be practiced as shown in FIGS. 1, 3, 4 and 5 with the magnets 92 being positioned within the mold 132 to provide the magnetic roll 40, the magnets may alternatively be positioned in the sleeve subsequent to the molding process as shown in FIG. 6.

Referring now to FIG. 6, an alternative embodiment of the present invention is shown in magnetic roll 240. Magnetic roll 240 is similar to magnetic roll 40 of FIGS. 1, 3 and 4, except that magnetic roll 240 includes magnets 292 which are placed into the core 282 subsequent to the molding process. The magnetic roll 240 includes core 282 which is similar to core 82 of roll 40, except that core 282 is molded without the magnets in position in the mold. The core 282 is molded of any suitable durable material, for example, any of the materials previously mentioned for the core 82. The core 282 is molded about shaft 280. Shaft 280 is similar to shaft 80 of the magnetic roll 40 and is manufactured with similar materials, for example, cold rolled steel.

The core 282 includes pockets 290. The pockets 290 may have any suitable shape but preferably include a bottom surface 204 which is described by radius RD from centerline 286 of shaft 280. Extending gradually outwardly from bottom 204 of the pocket 290 are first wall 206 and second wall 210. To provide for accurate positioning of the magnets 292 within pockets 290, preferably, the first wall 206 and the second wall 210 define an included angle θ. The angle θ is preferably an acute angle, for example, 15 to 30 degrees. Similarly the magnets 292 preferably have an included angle β between opposed walls 270 and 272 with first wall 270 mating against first wall 206 of the pocket and second wall 272 mating against second wall 210 of the pocket 290. The angles θ and β are preferably identical to provide for an accurate positioning of the magnet 292.

The core 282 is defined by a core diameter $D_{S2}$ which is smaller than the diameter $D_{R2}$ of the magnetic roll 240. The diameter $D_{R2}$ of the roll 240 is accurately maintained by first maintaining the radius $R_O$ of the bottom 204 of the pocket 290 as well as radial length L of the magnet 292. If a very accurate diameter $D_{R2}$ is required, the magnets 292 may alternatively have the dimension $D_{R2}$ held very accurately with subsequent machining thereof after assembly of the magnet 92 or the dimensions L and $R_O$ may be held more accurately by subsequent machining, for example by turning, grinding or honing.

The diameter $D_2$ of the shaft 280 is preferably similar to the diameter of shaft 80, for example, 0.30 inches for a roll 240 with a diameter $D_{R2}$ of approximately 2.00 inches. The corresponding core 282 would have a diameter $D_{S2}$ of approximately 1.7 inches.

Subsequent to the molding of the core 282 about the shaft 280, the magnets 292 are positioned in the pockets 290.

The magnets 292 may be secured to the pockets 290 by any suitable method. For example, by application of adhesive 294 therebetween. Adhesive 294 may be any suitable adhesive, for example, cyanoacrylate or epoxy.

In addition to the adhesive 294 or in place of the adhesive, mechanical locking of the magnet to the pocket may be provided. For example, if the angle θ is selected to be smaller than angle β, the magnet 292 may be pressed into pocket 290 providing an interference therebetween. Alternatively, the core 282 may include a first feature in the form of a pressure tab 250 which mates with second feature, for example, notch 252 in magnet 290. conversely, the notch (not shown) may be located in wall 206 of the core 282, with the tab (not shown) being located in magnet 290.

Figure 7:
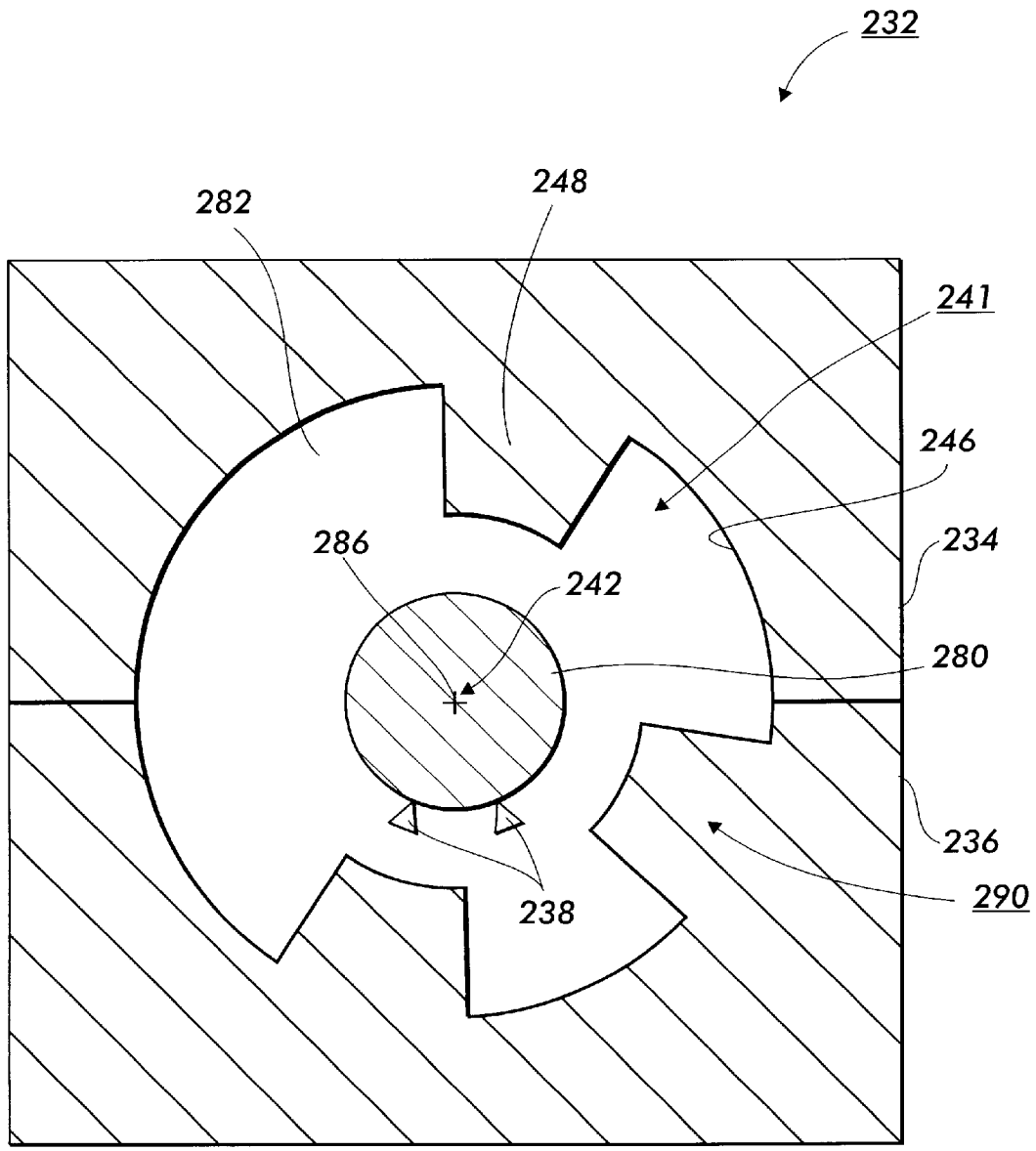
FIG. 7 is an elevational view of a mold for molding the FIG. 6 magnetic roll including the separately molded magnets.

Referring now to FIG. 7, mold 232 for manufacturing magnetic roll 240 is shown. Mold 232 includes first die half 234 and second die half 236 which are similar to die halves 134 and 136 of mold 132 of FIG. 5, except that provisions for placing magnets 292 are not present in mold 232. Mold 232 alternatively includes protrusions 248 extending inwardly from outer periphery 246 of the mold 232. Protrusions 248 are used to form pockets 290 and the core 282. The mold 232 further includes shaft supports 238 similar to shaft support 138 of mold 132. The shaft supports 238 position shaft 280 such that shaft centerline 286 is co-linear with mold centerline 242. Mold cavity 241 is filled with a material similar to the material utilized in mold 32 to provide for core 82. Again as in mold 132 of FIG. 5, the mold 232 may be integral or may include three or more die segments.

Figure 8:
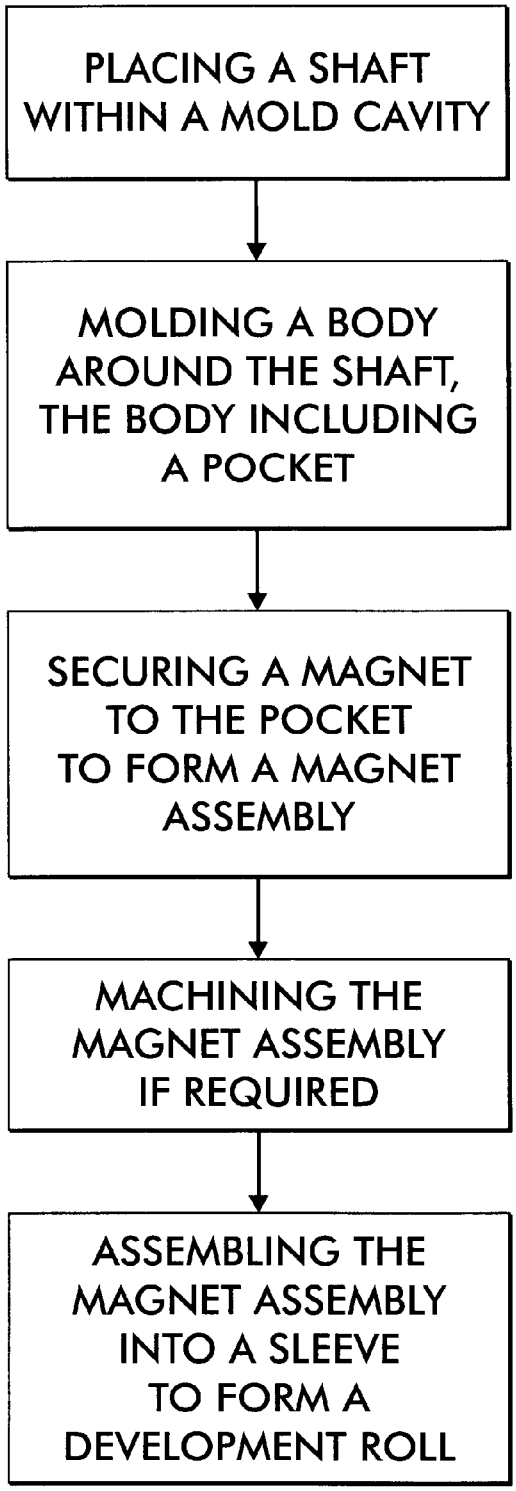
FIG. 8 is a block diagram of a process for manufacturing the molded pocket magnetic roll of FIG. 6.

Referring now to FIG. 8, a process is shown for manufacturing the magnetic roll 40 of FIG. 1. The process includes the first step of placing a shaft within a mold cavity. The second step includes molding a core around this shaft. The core includes a pocket. The next step provides for securing a magnet to the pocket to form a magnet assembly. The fourth step provides for machining the magnet assembly, if required. The fifth step provides for assembling the magnet assembly into a sleeve to form developer roll 116.

Figure 9:
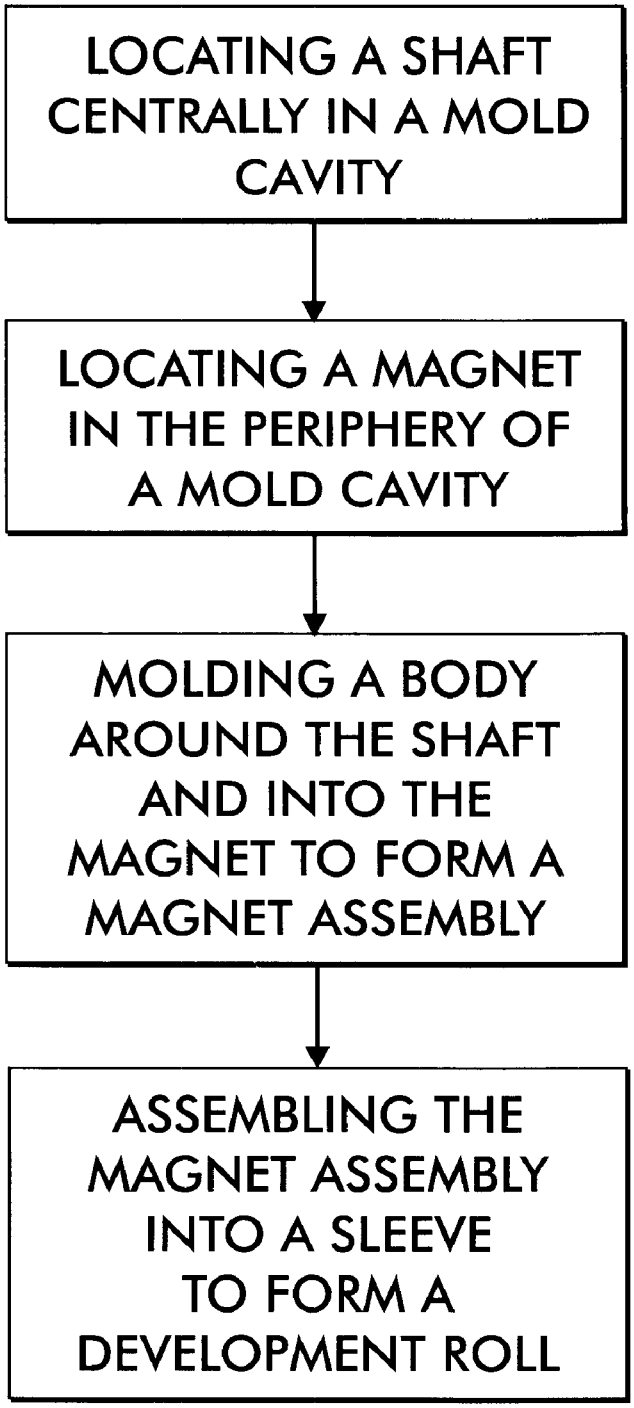
FIG. 9 is a block diagram of a process for manufacturing the molded pocket magnetic roll of FIG. 1.

Referring now to FIG. 9, a process is shown for manufacturing the magnetic roll 240 of FIG. 5. The process includes the steps of first locating a shaft centrally in a mold cavity. A second step includes locating a magnet into the periphery of a mold cavity. The third step provides for molding a core about a shaft and into the magnet to form a magnet assembly. The fourth step provides for assembling the magnet assembly into a sleeve to form a development roll.

By providing a magnetic roll with molded-in magnets, a magnetic roll may be provided without an adhesive and related costs of environmental and safety regulations.

By providing a magnetic roll with molded-in magnets, a magnetic roll is provided without the assembly costs to assemble the magnets into the magnetic roll.

By providing a magnetic roll with molded-in magnets, a magnetic roll is provided with accurately positioned magnets which require no further machining of the periphery of the magnets.

By providing a magnetic roll core with magnet pockets, a magnetic roll is provided with accurate magnet positioning obviating the need for subsequent machining of the magnets.

By providing a magnetic roll core with magnet pockets, a magnetic roll is provided with durable magnet support.

By providing a magnetic roll core with wedge-shaped pockets, a magnetic roll is provided with accurate positioning and durable support without adhesives.

By providing a magnetic roll core with locking tabs, a magnetic roll is provided with accurate positioning and durable support without the addition of adhesives.

By providing a magnetic roll core with low pressure molding requirements, a magnetic roll may be manufactured with a much wider variety of moldable materials.

By providing a magnetic roll core with low pressure molding requirements, a magnetic roll may be manufactured with improved dimensional accuracy.

While this invention has been described in conjunction with various embodiments, it is evident that many alternatives, modifications, and variations will be apparent to those skilled in the art. Accordingly, it is intended to embrace all such alternatives, modifications, and variations as fall within the spirit and broad scope of the appended claims.

What is claimed is:

1. A method for manufacturing a magnetic roll for use in an electrophotographic printing machine of the type having an electrostatic latent image recorded on a photoconductive member, said method comprising:

placing a shaft in a mold cavity;

molding a core in the mold cavity with the shaft in the cavity, said core defining a pocket on the periphery thereof;

molding a pressure tab into the pocket of the core to contain a magnet to the pocket;

placing the magnet in the pocket; and deflecting the pressure tab into the magnet to secure the magnet into the pocket.

2. The method of claim 1, further comprising adding a filler to the core made of a material selected from the group including milled glass, glass fibers, conductive fillers, non conductive fillers and reinforcements.

3. The method of claim 1, further comprising gluing the magnet to the pocket with an adhesive.

4. The method of claim 1, wherein molding a core comprises molding the core of a material selected from the group including polyesters, nylons, acrylics, urethanes and epoxies.

* * * * *

UNITED STATES PATENT AND TRADEMARK OFFICE

CERTIFICATE OF CORRECTION

PATENT NO. : 6,343,419 B1
DATED : February 5, 2002
INVENTOR(S) : Alan M. Litman et al.

It is certified that error appears in the above-identified patent and that said Letters Patent is hereby corrected as shown below:

Title page.
Delete "METHOD OF MANUFACTURING MAGNET ASSEMBLY WITH INSERTS" and insert -- MAGNET ASSEMBLY WITH INSERTS AND METHOD OF MANUFACTURING --.

Signed and Sealed this

Twenty-third Day of April, 2002

*Attest:*

*Attesting Officer*

JAMES E. ROGAN
*Director of the United States Patent and Trademark Office*